US005703635A

United States Patent [19]

Sasaki et al.

[11] Patent Number: 5,703,635

[45] Date of Patent: Dec. 30, 1997

[54] THERMAL TRANSFER COLOR RECORDING DEVICE

[75] Inventors: Naotaka Sasaki, Kiryu; Kenju Sugaya, Maebashi; Fumio Nakahashi, Ibaraki-ken, all of Japan

[73] Assignee: Japan Servo Co., Ltd., Tokyo, Japan

[21] Appl. No.: 722,938

[22] Filed: Sep. 30, 1996

Related U.S. Application Data

[63] Continuation of Ser. No. 204,444, Mar. 2, 1994, abandoned.

[30] Foreign Application Priority Data

Mar. 8, 1993 [JP] Japan ..... 5-070771

[51] Int. Cl.[6] ..... B41J 2/325; B41J 2/32

[52] U.S. Cl. ..... 347/176; 347/218

[58] Field of Search ..... 400/578, 617, 400/618; 347/215, 218, 172, 174, 176

[56] References Cited

U.S. PATENT DOCUMENTS

| | | | |
|---|---|---|---|
| 4,910,530 | 3/1990 | Fukumoto et al. | 347/219 |
| 4,972,207 | 11/1990 | Ishiyama et al. | 347/219 |
| 4,985,711 | 1/1991 | Nakamura et al. | 347/219 |
| 5,001,498 | 3/1991 | Shimizu et al. . | |
| 5,021,804 | 6/1991 | Nozawa et al. . | |
| 5,160,944 | 11/1992 | Fukumoto et al. | 347/219 |

FOREIGN PATENT DOCUMENTS

| | | |
|---|---|---|
| 61-37955 | 3/1986 | Japan . |
| 1-171655 | 12/1989 | Japan . |
| 3-23969 | 1/1991 | Japan . |

*Primary Examiner*—Huan H. Tran

*Attorney, Agent, or Firm*—Birch, Stewart, Kolasch & Birch, LLP

[57] ABSTRACT

A thermal transfer color recording device comprising a recording portion for effecting thermal transfer color recording by clamping and conveying an ink sheet on which ink of two or more colors being applied respectively on areas nearly equal to or larger than desired recording areas and a recording paper between a thermal head having a plurality of rectilinear heating elements and a platen roller adapted to selectively press the heating elements. A grip roller is located downstream side from the recording portion for clamping and conveying the recording paper between a pinch roller being resiliently biassed agaist the grip roller. An auxiliary roller is located upstream side from the recording portion and clamping and conveying the recording paper only between the platen roller. There are provided minute projections on the surface of the grip roller for ensuring the gripping and conveying operation.

2 Claims, 6 Drawing Sheets

THERMAL TRANSFER COLOR RECORDING DEVICE

This application is a continuation of application Ser. No. 08/204,444 filed on Mar. 2, 1994, now abandoned.

TECHNICAL FIELD

This invention relates to a thermal transfer color recording device which records a desired color image on a recording paper by pressing and conveying an ink sheet, on which ink of two or more colors being sequentially applied on areas nearly equal to or larger than desired recording areas, and the recording paper between a thermal head having a plurality of rectilinear heating elements and an opposing platen roller, thereby thermally transferring the ink from the ink sheet to the recording paper so that a desired visual color image is formed on the recording paper and, particularly, to the technique for enlarging possible recording zone and improving the recording accuracy.

PRIOR ART

Japanese Patent Kokai 62-9975 (1987), Japanese Patent Kokai 2-95874 (1990) and Japanese Patent Kokai 2-108576 (1990) show thermal transfer color recording devices utilizing thermal tranferring recording system. In these prior art devices, there are shown methods for improving the recording paper conveying accuracy of the recording paper utilizing clamping and conveying mechanisms in the color recording devices. In Japanese Patent Kokai 62-9975 (1987) (case A), the tip end of the recording paper is clamped and secured by clamping claws provided on a drum such that the recording paper is precisely conveyed by the rotation of the drum, and the thermal transfer is effected at platen rollers provided at a distinct location. In Japanese Patent Kokai 2-95874 (1990) (case B), there is provided on the upstream and downstream side of the recording portion, a recording paper conveying means including a grip roller and a pinch roller being resiliently urged toward the grip roller. The downstream rollers transport the recording paper during the recording operation, and the upstream rollers prevent the slack of the recording paper, thereby improving the recording accuracy. In Japanese Patent Kokai 2-108576 (1990) (case C), there are provided sequentially from the upstream side of the recording paper, conveying path paper moving rollers, platens, and capstans (corresponding to grip rollers), with the capstans being connected to a drive means, the platens being connected through one-way motion transmitting mechanism having different drive ratio between the normal and opposite directions to the capstans, and the paper moving rollers being connected to the platens through a slip mechanism, such that tension is applied on the recording paper between the capstans and the platens during the normal operation, and between the capstans and the paper moving rollers during the reverse or rewinding direction, thereby removing the slack on the recording paper. However, in case A, the range available for recording on the recording paper is reduced by the clamping, and a large size drum having a circumference nearly equal to the length of the recording paper enlarges the size of the device. In cases B and C, two sets of conveying means consisting of grip rollers and the like increase the number of parts and to increase the size of the device and the cost. Further, the possible recording area of the recording paper is reduced by an amount equal to the distance between the recording portion and the paper conveying device and, since a predetermined space is provided between the recording portion and the paper moving rollers of the reverse direction, it is required to rely on the rigidity of the recording paper during the reverse movement of the recording paper in preparing the next recording operation until the rear end of the recording paper aligns with the paper, conveying rollers. Therefore the paper conveying operation cannot be effected smoothly particularly when the thickness of the recording paper is thin.

An object of the present invention is to provide a thermal transfer color recording device that prevents the dislocation of the recording paper in the conveyance of the recording paper, that has a large recording area with a small sized apparatus and superior quality in the printing.

BRIEF SUMMARY OF THE INVENTION

According to the present invention, there is provided a thermal transfer color recording device comprising a recording portion for effecting thermal transfer color recording by clamping and conveying an ink sheet, on which ink of two or more colors being applied respectively on areas nearly equal to or larger than desired recording areas, and a recording paper between a thermal head having a plurality of rectilinear heating elements and a platen roller adapted to selectively press the heating elements, a grip roller located downstream from the recording portion in a recording direction of the recording paper, and having minute projections on its surface for clamping and conveying the recording paper between a resiliently biased pinch roller, and an auxiliary roller located upstream from the recording portion for clamping and conveying only the recording paper between the auxiliary roller and the platen roller for ensuring the conveying operation.

Since the recording paper is clamped and conveyed between the grip roller having minute projections on its surface and the auxiliary roller resiliently urged against the platen, it is possible to prevent the dislocation of the recording paper being conveyed reciprocatingly during the color transferring operation, and to constitute an inexpensive and compact thermal transfer color recording device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be better understood with reference to the description which follows and the attached drawings, which are given by way of non-limiting example of preferred embodiments, wherein.

DETAILED DESCRIPTION OF PREFERRED EMBODIMENTS

Figure 1:
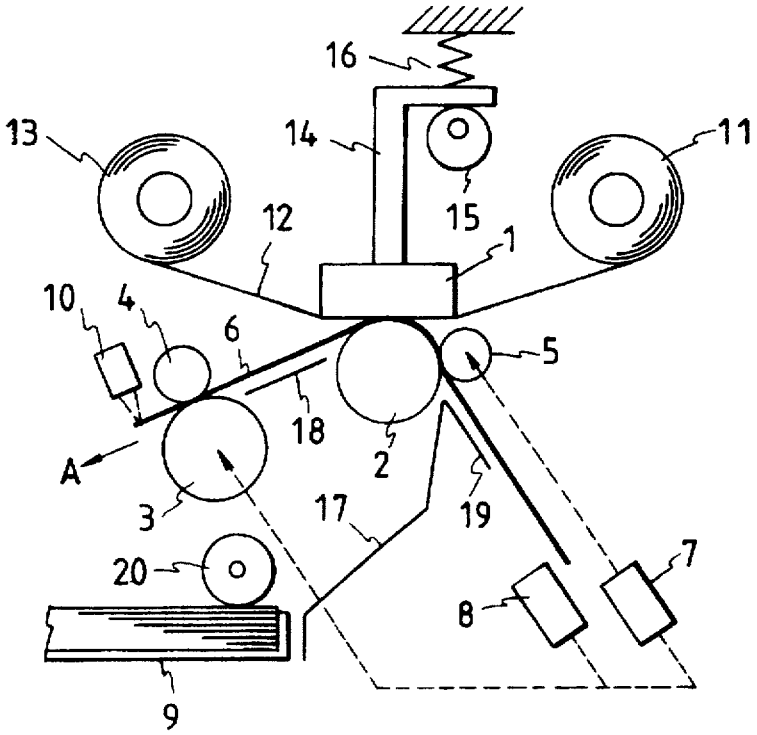
FIG. 1 is a schematic view showing the constitution of a thermal transfer color recording device according to a first embodiment of the invention.

FIG. 1 shows a schematic constitution of a thermal transfer color recording device according to a first embodiment of the invention, in which, a thermal head 1 having a plurality of rectilinear heating elements cooperates with a resilient platen roller 2 formed of rubber and the like and being urged against the thermal head 1 by a head pressurizing spring 16 so as to clamp therebetween an ink sheet 12 and a recording paper 6 being supplied from a stacker 9, and by supplying a predetermined electric current to the heating elements, whereby the ink on the ink sheet 12 is thermally transferred to the recording paper 6. The thermal head 1 and the platen roller 2 constitute a recording portion. The ink sheet 12 is supplied from a supply roll 11, and is wound through the thermal head 1 onto a winding roll 13 by an ink sheet drive motor (not shown in the drawing).

Figure 3:
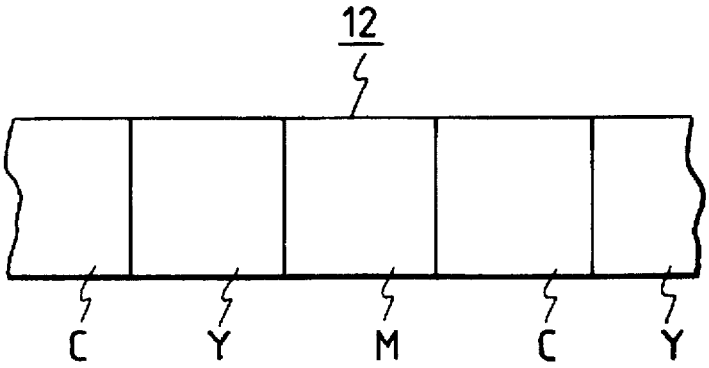
FIG. 3 is a schematic view showing a color constitution of an ink sheet utilized in the device of FIG. 1.

There are provided on the ink sheet 12, as shown in FIG. 3, color inks such as yellow Y, magenta M and cyanine C, which are sequentially and repeatingly applied with the areas being equal to or larger than the respective recording areas. The inks are melted by the heat of predetermined temperature generated by the heating elements of the thermal head 1 and are transferred on the recording paper 6. Thereafter, the inks are solidified to make a desired color image. It will be noted that the order of the color is shown as Y-M-C-Y-M-C . . . in FIG. 3, but the order may be changed as desired and other color(s) such as black and the like may be added.

There are provided, as shown in FIG. 1, on the downstream side of the recording portion in the recording direction of the recording paper (arrow A direction), a recording paper conveying means including of a grip roller 3 having on the surface minute projections and recesses for attaining a large frictional force and a rotatable pinch roller 4 being resiliently biased against the grip roller 3 for clamping therebetween the recording paper 6 and conveying precisely the recording paper. The recording paper 6 is gripped between the grip roller 3 and the pinch roller 4 and conveyed on a guide plate 18 in the recording direction of the recording paper. When the tip end of the recording paper 6 is detected by a photo-reflective type detecting sensor 10, the heat transfer recording is effected at the recording portion (1 and 2). An auxiliary roller 5 is provided on the upstream side of the recording portion in the recording direction of the recording paper and is biased against the platen roller 2 so as to assist the conveying of the recording paper 6 in the direction opposite the recording direction.

When the thermal transferring operation of yellow Y, for example, is completed, a head moving cam 15 is rotated by a half turn and pushes upward a thermal head supporting member 14 against the force of a spring 16, thereby separating the thermal head 1 from the platen roller 2. The ink sheet 12 is moved such that the tip end of the next color magenta M is located to a predetermined position, and the recording paper 6 is conveyed in the arrow B direction to the position as detected by the sensor 10. Then, the cam 15 is rotated by a half turn and the thermal head 1 is urged against the platen roller 2. The recording paper 6 is conveyed in the arrow A direction and the heat transfer operation of the magenta M is started. Similar operation is repeated and desired color image is formed on the recording paper 6.

Figure 2:
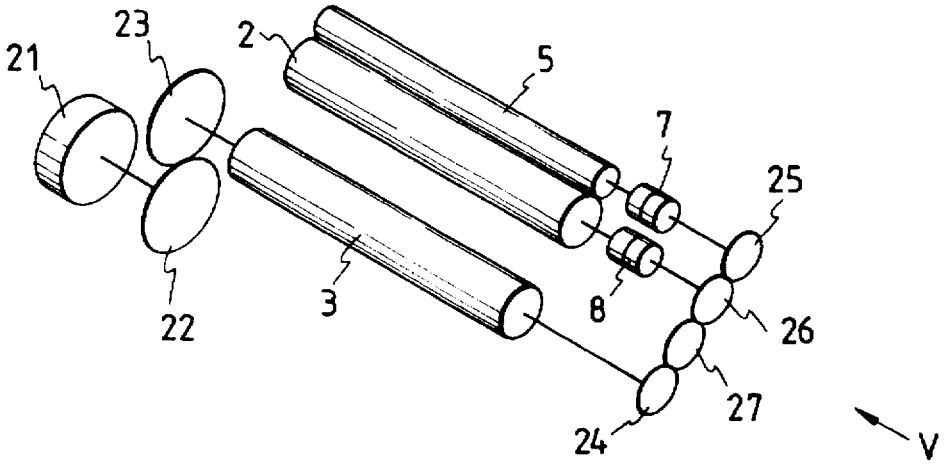
FIG. 2 is a schematic view showing the constitution of a recording paper conveying mechanism in the device of FIG. 1.

As described above, the recording paper 6 is conveyed reciprocatingly for effecting respective color transferring operations, and is performed by the cooperation of the grip roller 3 and the pinch roller 4, and the platen roller 2 and the auxiliary roller 5. As shown in FIG. 2, the rotation of a drive motor 21 is transmitted through a drive gear 22 and a platen gear 23 to the grip roller 3, and through a transmission gear 24, an intermediate gear 27, a second gear 26 and a second clutch 8 to the platen roller 2. The second gear 26 also drives a first gear 25 to rotate the auxiliary roller 5 through a first clutch 7. The number of gear teeth of the transmission gear 24, the first gear 25 and the second gear 26 are respectively Z1, Z2 and Z3. The first gear 25 and the second gear 26 engage directly.

The relationship between the number of teeth is determined such that $Z3<Z1<Z2$, and the intermediate gear 27 has the number of teeth of Z1 in the embodiment. The first clutch 7 transmits the rotation of the first gear 25 to the auxiliary roller 5 only in the clockwise direction as viewed in arrow V direction, and the second clutch 8 transmits the rotation of the second gear 26 to the platen roller 2 only in the clockwise direction as viewed in arrow V direction.

Thus, when the grip roller 3 is rotated in the counterclockwise direction as viewed in arrow V direction, the gear 24 rotates in the same direction, and the second gear 26 also rotates in the same direction, but the platen roller 2 does not rotate due to the second clutch 8. The rotation of the second gear 26 is transmitted to the first gear 25 and the auxiliary roller 5 is rotated with the relationship of (the circumferential speed of the auxiliary roller 5)<(the circumferential speed of the grip roller 3) being realized.

When the grip roller 3 is rotated in the clockwise direction as viewed in arrow V direction, the gear 24 rotates in the same direction, and the second gear 26 rotates in the same direction and which rotation is transmitted to the platen roller 2. While, the first gear 25 directly engaging with the second gear 26 rotates in the counterclockwise direction which is not transmitted to the auxiliary roller 5. At that time the relationship of (the circumferential speed of the grip roller 3)<(the circumferential speed of the platen roller 2) is realized. Thus the recording paper 6 located between the grip roller 3 and the auxiliary roller 5 receives tension irrespective to the direction of the rotation of the grip roller 3.

Figure 4:
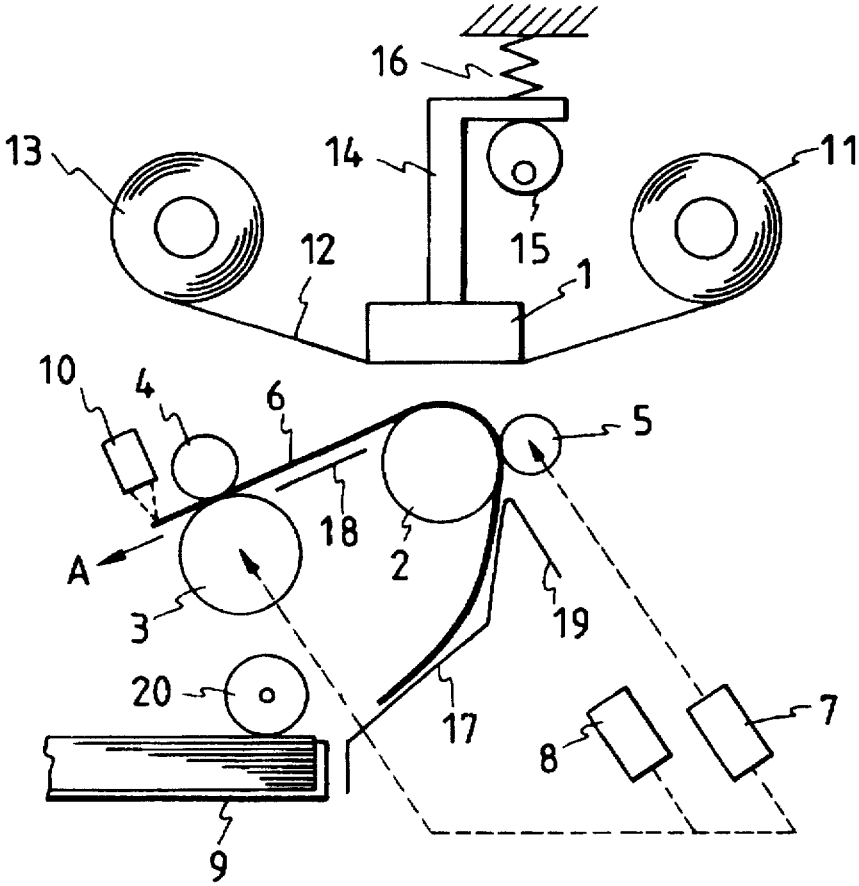
FIG. 4 is a schematic view showing the recording paper being conveyed.

FIG. 4 shows the loading condition when the recording paper 6 is taken out of the stacker 9 and is guided to the grip

BEST AVAILABLE COPY roller 3 of the main conveying mechanism. Prior to the loading of the recording paper 6, the thermal head 1 is moved upward of the platen roller 2 by the cam 15. A sufficient space is formed between the thermal head 1 and the platen roller 2.

There is a plurality of recording papers 6 in the stacker 9, with a paper feed roller 20 being resiliently urged against the uppermost paper. When the feed roller 20 is rotated, one sheet of the recording paper is moved along a guide plate 17 to the position between the platen roller 2 and the auxiliary roller 5. The paper 6 is clamped between the rollers 2 and 5 is conveyed along the guide plate 18 by the rotation of the roller 5 to the grip roller 3.

When the tip end of the recording paper 6 is positioned at the sensor 10 as shown in FIG. 4, the position is utilized as the original position of the paper 6 during the thermal transfer operation being performed thereafter. The recording paper 6 is further moved in arrow A direction such that the rear end of the paper 6 clears the guide plate 17. When and after the tip end of the paper 6 is clamped between the grip roller 3 and the pinch roller 4, due to the relationship of (the circumferential speed of the auxiliary roller 5)<(the circumferential speed of the grip roller 3), a tension acts on the paper 6 during the movement in the arrow A direction.

Figure 5:
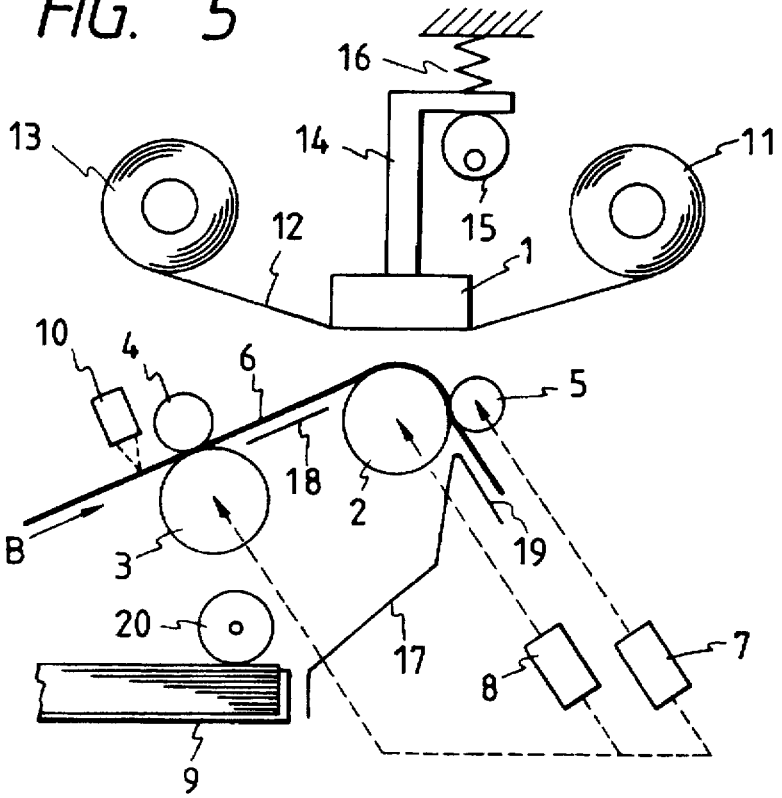
FIG. 5 is a schematic view showing the recording paper being conveyed in the reverse direction.
Figure 6:
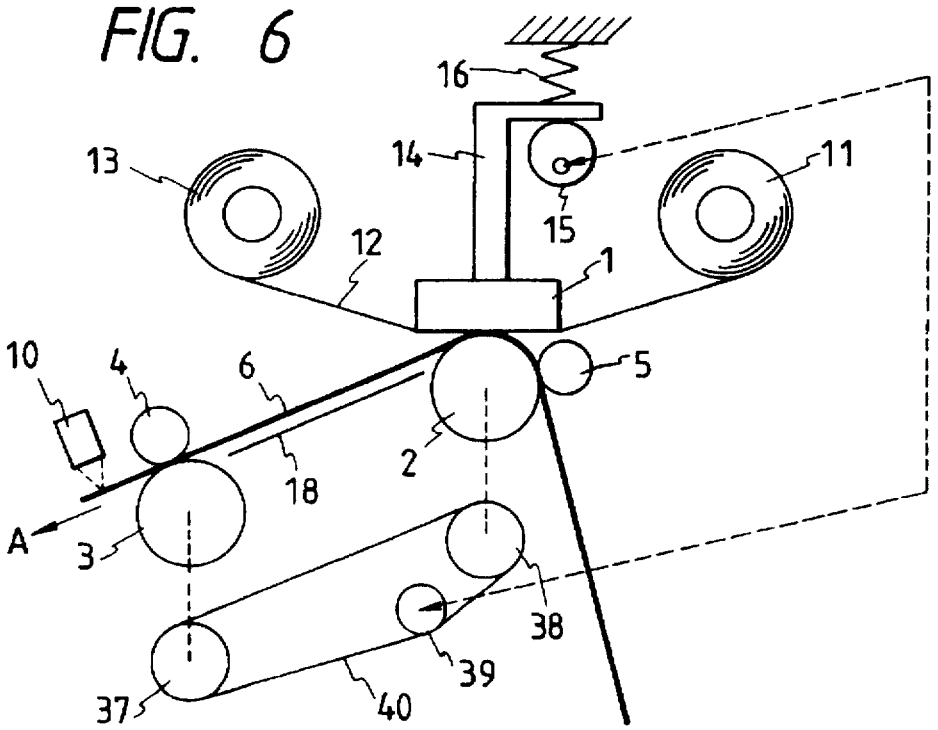
FIG. 6 is a schematic view showing the constitution of a thermal transfer color recording device according to a second embodiment of the invention.

When the rear end of the paper 6 clears completely the guide plate 17, the recording paper 6 is moved in the arrow B direction in FIG. 5 by the rotation of

* * * * *

UNITED STATES PATENT AND TRADEMARK OFFICE

CERTIFICATE OF CORRECTION

PATENT NO. : 5,703,635

DATED : December 30, 1997

INVENTOR(S) : Naotaka Sasaki, et. al.

It is certified that error appears in the above-identified patent and that said Letters Patent is hereby corrected as shown below:

Delete columns 5 & 6 and substitute columns 5 & 6 as shown on the attached page.

Add columns 7 & 8 as shown on the attached page.

Signed and Sealed this

First Day of September, 1998

Bruce Lehman

*Attest:*

BRUCE LEHMAN

*Attesting Officer*

*Commissioner of Patents and Trademarks* roller 3 of the main conveying mechanism. Prior to the loading of the recording paper 6, the thermal head 1 is moved upward of the platen roller 2 by the cam 15. A sufficient space is formed between the thermal head 1 and the platen roller 2.

There is received a plurality of recording papers 6 in the stacker 9, with a paper feed roller 20 being resiliently urged against the uppermost paper. When the feed roller 20 is rotated, one sheet of the recording paper is moved along a guide plate 17 to the position between the platen roller 2 and the auxiliary roller 5. The paper 6 is clamped between the rollers 2 and 5 is conveyed along the guide plate 18 by the rotation of the roller 5 to the grip roller 3.

When the tip end of the recording paper 6 is positioned at the sensor 10 as shown in FIG. 4, the position is utilized as the original position of the paper 6 during the thermal transfer operation being performed thereafter. The recording paper 6 is further moved in arrow A direction such that the rear end of the paper 6 clears the guide plate 17. When and after the tip end of the paper 6 is clamped between the grip roller 3 and the pinch roller 4, due to the relationship of (the circumferential speed of the auxiliary roller 5)<(the circumferential speed of the grip roller 3), a tension acts on the paper 6 during the movement in the arrow A direction.

When the rear end of the paper 6 clears completely the guide plate 17, the recording paper 6 is moved in the arrow B direction in FIG. 5 by the rotation of the platen roller 2 and of the grip roller 3. The rear end of the paper 6 moves along a guide plate 19. During the movement in the arrow B direction, owing to the relationship of (the circumferential speed of the grip roller 3)<(the circumferential speed of the platen roller 2), a tension acts on the paper 6. When the tip end of the paper 6 is detected by the sensor 10, the movement of the paper 6 in the arrow B direction is terminated, and the thermal transferring operation can be started.

The thermal transferring operation is performed as shown in FIG. 1, with the thermal head 1 being lowered by the rotation of the cam 15 and by the spring 16 such that the ink sheet 12 and the recording paper 6 are pressed between the thermal head 1 and the platen roller 2, and the recording paper 6 is conveyed in the arrow A directiion in FIG. 1 by the rotation of the grip roller 3 and of the auxiliary roller 5 with the rotation of the latter being reduction transmitted from the former through the gears (24, 27, 26 and 25) and the first clutch 7. When the thermal transfer of one color is completed the paper 6 is conveyed in the arrow B direction as shown in FIG. 5, and the thermal transfer is performed with respect to the next color. The operation is repeatedly performed so that respective colors have been transferred. It will be noted that suitable tension is applied on the recording paper 6 during the movement in both directions.

In the embodiment, there are provided gear trains 22, 23, 24, 27, 26 and 25 for transmitting the rotation of the motor 21 to the rollers 2, 3 and 5, but other means such as a timing belt and the like may be substituted. Further, the recording paper 6 is a cut paper of a predetermined size, which may be substituted by a roll paper.

Second Embodiment

FIG. 6 through FIG. 14 show a second embodiment, in which parts corresponding to that of the first embodiment are denoted by the same reference numerals and detailed description thereof is omitted.

There are provided a first belt wheel 37 coaxially with the grip roller 3, a second belt wheel 38 coaxially with the platen roller 2, a guide wheel 39 and a belt 40 extending around the first and second belt wheels 37 and 38 and the guide wheel 39. The guide wheel 39 is connected to the head moving cam 15 and is displaceable in the axial direction.

Figure 7:
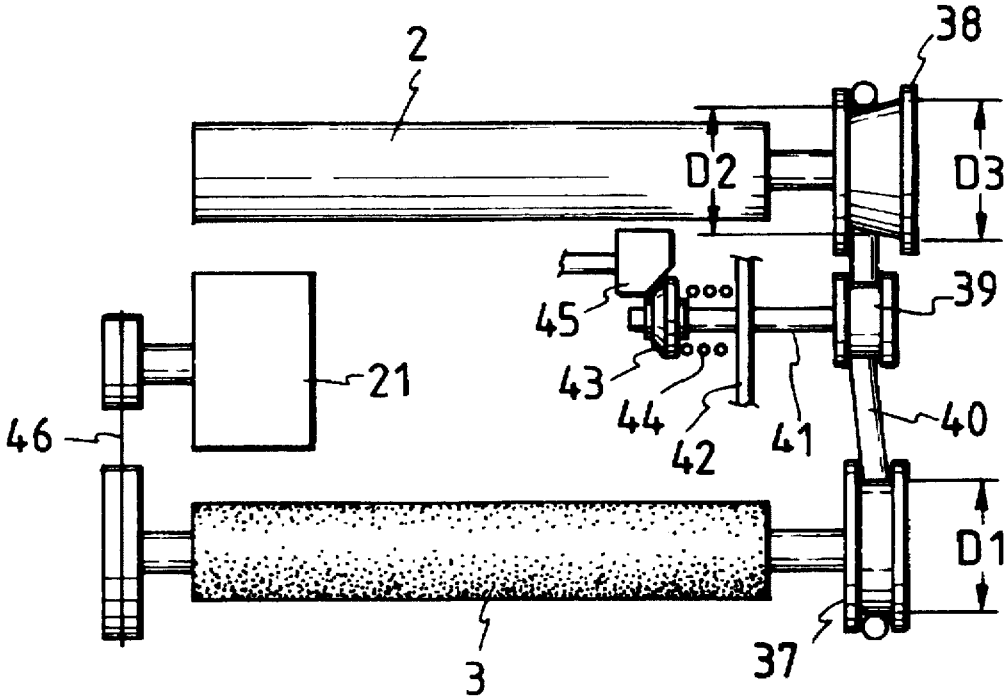
FIG. 7 is a schematic view showing the constitution of a grip roller and a platen roller in the device of FIG. 6.

FIG. 7 shows the details of the driving system of the platen roller 2 and the grip roller 3. As shown in the drawing, the rotation of the drive motor 21 is transmitted to the grip roller 3 through a dirve belt 46, and the grip roller 3 drives the platen roller 2 through the belt wheels 37 and 38 and through the belt 40. As shown in FIG. 7, the belt wheel 37 has the diameter D1 and the belt wheel 38 has a truncated conical guide surface having a small diameter D2 and a large diameter D3. The relationship between these diameters is determined as (D2)<(D1)<(D3). The diameter of the platen roller 2 is equal to that of the grip roller 3.

Thus, when the belt 40 engages with the small diameter portion D2 of the belt wheel 38, the circumferential speed of the platen roller 2 is larger than that of the grip roller 3 and, the recording paper 6 is conveyed in arrow A direction with a slack between the rollers 2 and 3, and the paper 6 is conveyed in the direction opposite to arrow A direction with a tension. While, when the belt 40 engages with large diameter portion D3 of the belt wheel 38, the circumferential speed of the platen roller 2 is smaller than that of the grip roller 3 and, the recording paper 6 is conveyed in arrow A direction between the rollers 2 and 3 at a tension.

Such transverse movement of the belt 40 is effected by the axial movement of the guide wheel 39. A shaft 41 secured to the guide wheel 39 is rotatably mounted on a supporting plate 42. The shaft 41 further extends inward from the supporting plate 42 and mounts thereon a slide member 43 formed of an oily bearing material. The slide member 43 is rotatably but axially non-displaceably mounted on the shaft 41. A coil spring 44 of compression type acts between the slide member 43 and the supporting plate 42. A cam 45 cooperates with the slide member 43 to move the guide wheel 39 axially against the force of the spring 44 so that the belt 40 engages with the portion of the diameter D3 of the second belt wheel 38.

Figure 8:
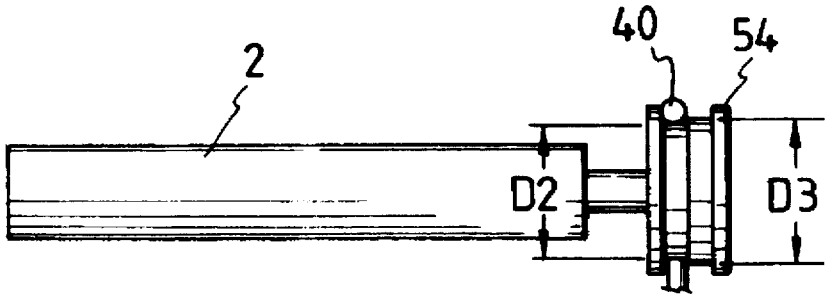
FIG. 8 is a view showing alternate form of the second belt wheel in the device of FIG. 6.

FIG. 8 shows an alternate form of the second belt wheel 38 in FIG. 7, such that the truncated conical surface in FIG. 7 is substituted by stepped cylindrical surfaces having diameters of D2 and D3. This embodiment is advantageous in that the speed of the platen roller 2 can be controller precisely.

In FIG. 7, the shaft 41 is secured to the guide wheel 39 to rotate integrally therewith, but the shaft 41 may rotatably and axially non-displaceably mount the guide wheel 39.

FIG. 8 shows a driving mechanism for driving the thermal head moving cam 15 and the guide wheel moving cam 45. The driving force of a head moving motor 47 is transmitted to the cams 15 and 45 through gear trains 48, 49 and 51. The cam 45 is formed to have a cut surface portion 55.

Figure 9:
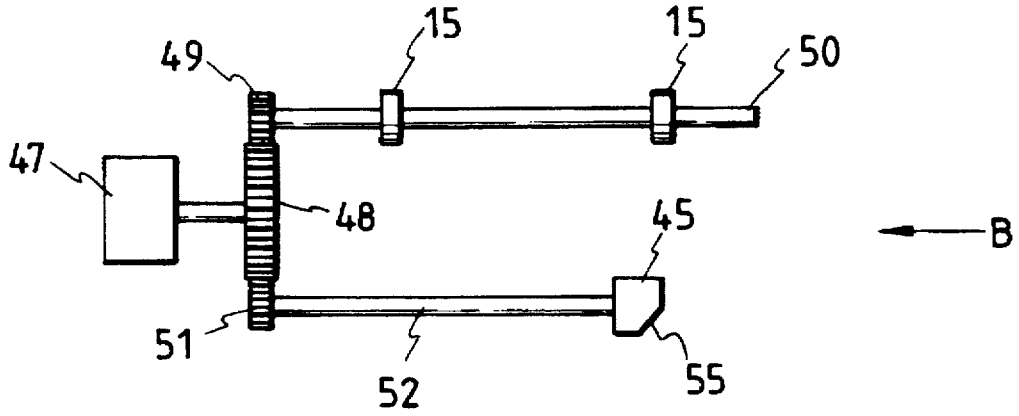
FIG. 9 is a schematic view showing the mechanism effecting the transverse movement of a guide wheel and vertical movement of a thermal head.
Figure 10:
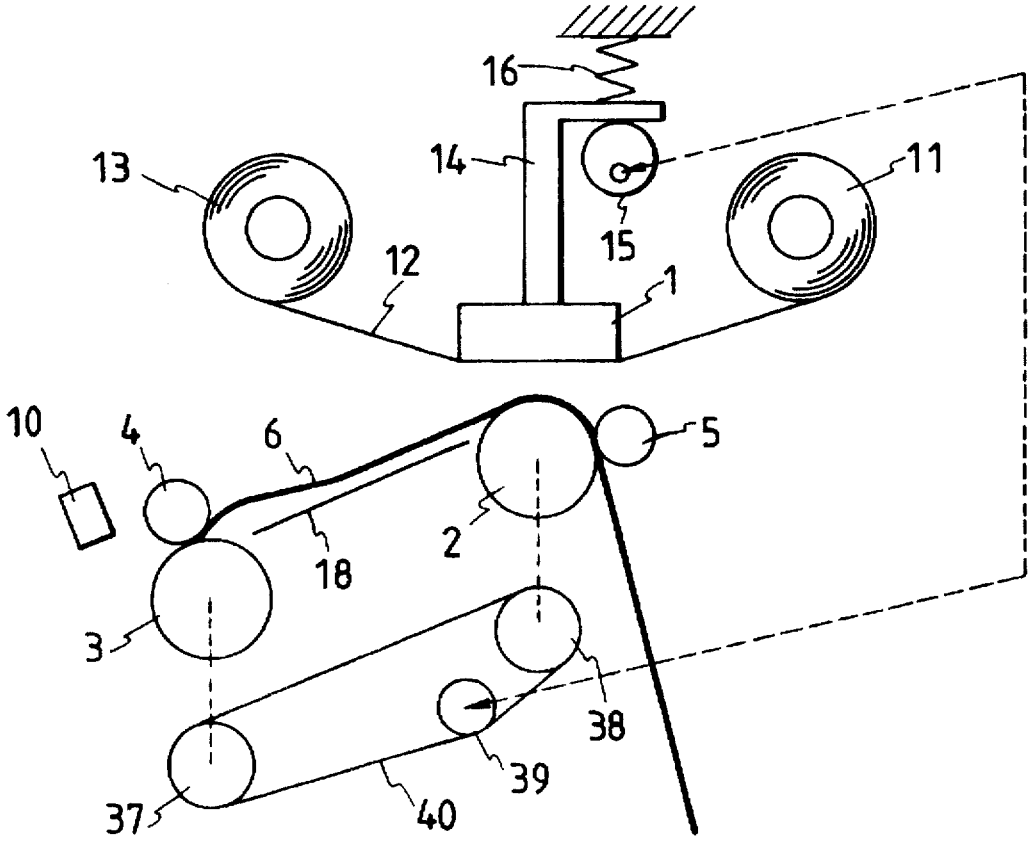
FIG. 10 is a schematic view showing the initial condition of the recording paper conveyor in the device of FIG. 6.
Figure 11:
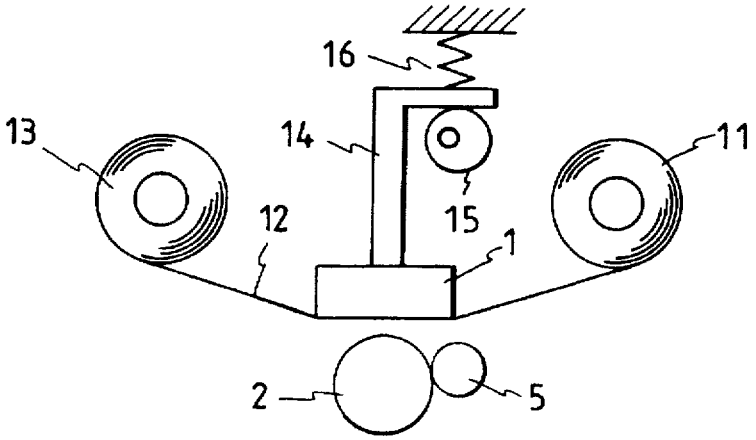
FIG. 11 is a schematic view showing the condition when the thermal head is in an intermediate position.
Figure 12:
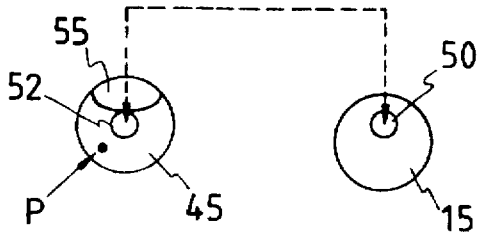
FIG. 12 is a schematic view showing the relation between a head driving cam and a speed changing cam when the thermal head is at a first position.
Figure 13:
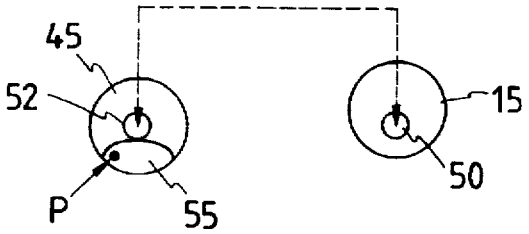
FIG. 13 is a schematic view showing the relation between a head driving cam and a speed changing cam when the thermal head is at a second position.
Figure 14:
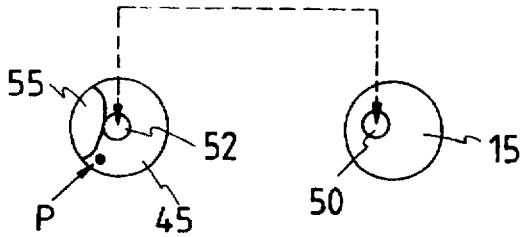
FIG. 14 is a schematic view showing the relation between a head driving cam and a speed changing cam when the thermal head is at an intermediate position.

FIGS. 12, 13 and 14 show the relationship between the cam 15 and the cam 45 as viewed along arrow B in FIG. 9. At FIG. 12, the thermal head 1 is urged against the platen roller 2, at FIG. 13, the thermal head 1 is moved upward from platen roller 2, and at FIG. 14, the thermal head 1 is moved upward from platen roller 2 with a small space being left therebetween for permitting free passage of the recording paper 6. In the drawings, respective points P show the points of the cam 45 contacting with the slide member 43. The position of the thermal head 1 at the condition of FIG. 14 is shown in FIG. 11. The head moving cam 15 at FIG. 13 is rotated by 180 degrees from the position of FIG. 12, and the position shown in FIG. 14 is rotated by about 100 degrees from the position of FIG. 13. Thus, the contact point P between the slide member 43 and the cam 45 is located on the cut portion only at the condition of FIG. 13, and at the conditions of FIGS. 12 and 14, the slide member 43 is pushed rightwardly as viewed in FIG. 7.

FIG. 7 shows the condition when the recording paper 6 is guided to the grip roller 3 prior to the start of the thermal transfer operation. The thermal head 1 is at the condition being controlled by the cams 15 and 45 of FIG. 13, thus, the relationship between the belt wheels 37 and 38 is controlled by (D1)>(D2). Thus, when the tip end of the recording paper 6 arrives at the grip roller 3 and the pinch roller 4, a slack is formed on the recording paper and the paper is regularly gripped by the rollers 3 and 4.

When the tip end of the paper is detected by the sensor 10, the cams 15 and 45 take the positions of FIG. 14 so that the slack between the rollers 2 and 3 is taken up and the paper is pulled out in A direction until the rear end of the paper takes the position near to the auxiliary roller 5.

Then, the cams take the positions of FIG. 13 again, and the paper 6 is moved in the direction opposite the A direction with a tension acting on the paper between the rollers 2 and 3 until the predetermined initial position is reached as determined by the sensor 10.

During the thermal transfer operation, the cams 15 and 45 take the condition of FIG. 12, and tension is applied between the rollers 2 and 3 by the relationship of (D1)>(D2). The heat transfer operation is performed repeatedly and sequentially on respective colors, and the tension acts on the paper between the rollers 2 and 3 during the reciprocating movement of the recording paper.

As described heretofore, according to the invention, there is provided a thermal transfer color recording device which can prevent the dislocation of the recording paper, increase the effective recording area, reduce the size of the device, and improve the quality of the printing.

What is claimed is:

1. A thermal transfer color recording device comprising:

a recording portion for effecting thermal transfer color recording, said recording portion including a platen roller and a thermal head, said thermal head having a plurality of rectilinear heating elements, means for moving said thermal head to selectively press said platen roller to clamp and convey an ink sheet, on which ink of two or more colors is applied respectively on areas nearly equal to or larger than desired recording areas, and a recording paper, between said thermal head and said platen roller;

a grip roller and a resiliently biased pinch roller located downstream from the recording portion in the recording direction of the recording paper, said grip roller having minute projections on its surface for clamping and conveying the recording paper between the grip roller and the resiliently biased pinch roller;

means for rotating the grip roller in a clockwise or counter-closkwise rotation, whereby counter-clockwise rotation of the grip roller conveys the recording paper in the recording direction;

means for conveying said ink sheet between said thermal head and said platen roller so that ink of two or more colors can be applied to said recording paper as the recording paper is conveyed by the grip roller;

an auxiliary roller located upstream from the recording portion in the recording direction of the recording paper for clamping and conveying the recording paper between the auxiliary roller and the platen roller;

first transmitting means for transmitting the rotation of the grip roller to the auxiliary roller at a reduced rate in the recording direction of the recording paper; and second transmitting means for transmitting the rotation of the grip roller to the platen roller at an increased rate in the direction opposite the recording direction of the recording paper.

2. The thermal transfer color recording device according to claim 1, wherein the first transmitting means comprises a first one-way clutch, and wherein the second transmitting means comprises a second one-way clutch.

* * * * *